US009153179B2

(12) United States Patent
Sacchetto et al.

(10) Patent No.: US 9,153,179 B2
(45) Date of Patent: Oct. 6, 2015

(54) DISPLAY SYSTEMS WITH HANDSHAKING FOR RAPID BACKLIGHT ACTIVATION

(75) Inventors: Paolo Sacchetto, Cupertino, CA (US); David J. Redman, Fremont, CA (US); Colin Witby-Strevens, Ben Lomond, CA (US)

(73) Assignee: Apple, Inc., Cupertino, CA (US)

( * ) Notice: Subject to any disclaimer, the term of this patent is extended or adjusted under 35 U.S.C. 154(b) by 499 days.

(21) Appl. No.: 13/588,978

(22) Filed: Aug. 17, 2012

(65) Prior Publication Data

US 2014/0049572 A1 Feb. 20, 2014

(51) Int. Cl.
*G09G 3/34* (2006.01)
*G09G 3/20* (2006.01)

(52) U.S. Cl.
CPC ..... *G09G 3/3406* (2013.01); *G09G 3/20* (2013.01); *G09G 2330/022* (2013.01); *G09G 2354/00* (2013.01)

(58) Field of Classification Search
CPC ..... G09G 2330/022; G09G 2330/026; G09G 3/3406
See application file for complete search history.

(56) References Cited

U.S. PATENT DOCUMENTS

| | | | | |
|---|---|---|---|---|
| 7,477,228 | B2 | 1/2009 | Wyatt | |
| 7,705,842 | B2 | 4/2010 | Panabaker et al. | |
| 2005/0177654 | A1* | 8/2005 | Tomohara | 710/22 |
| 2007/0115241 | A1* | 5/2007 | Teranishi | 345/98 |
| 2007/0211014 | A1 | 9/2007 | Kim et al. | |
| 2008/0172501 | A1* | 7/2008 | Goodart et al. | 710/33 |
| 2010/0085289 | A1* | 4/2010 | Munteanu et al. | 345/88 |
| 2011/0157241 | A1 | 6/2011 | Lee et al. | |
| 2012/0317607 | A1* | 12/2012 | Wyatt et al. | 725/127 |
| 2012/0320020 | A1* | 12/2012 | Chiba | 345/211 |

FOREIGN PATENT DOCUMENTS

WO 2006095304 9/2006

OTHER PUBLICATIONS

Rusling, "Polling and Interrupts," 2001, retrieved from http://www.science.unitn.it/~fiorella/guidelinux/tlk/node86.html on Mar. 26, 2015.*

Craig Wiley, "DisplayPort Technical Overview," IEEE International Conference on Consumer Electronics (ICCE) Advances & Challenges in HD Interconnects, Jan. 10, 2011, Las Vegas (40 pages).

* cited by examiner

*Primary Examiner* — Kee M Tung
*Assistant Examiner* — Ryan D McCulley
(74) *Attorney, Agent, or Firm* — Treyz Law Group; G. Victor Treyz; Joseph F. Guihan

(57) ABSTRACT

A system may include a graphics controller and a display. The graphics controller may generate video data to display on the display. The display may include a display panel for displaying the video data, a backlight unit for providing the display panel with backlight, and a display timing controller for communicating with the graphics controller over a communications path. The communications path may include a video data path for conveying video data bits, an interrupt path for conveying interrupts, and a sideband control path for conveying control signals such as a backlight enable signal for the backlight unit. The graphics controller and timing controller may perform link training operations to assess link quality between the graphics controller and timing controller. The timing controller may use interrupts to inform the graphics controller of system status. Use of the interrupts may help the system minimize the time consumed during display power-up operations.

11 Claims, 4 Drawing Sheets

DISPLAY SYSTEMS WITH HANDSHAKING FOR RAPID BACKLIGHT ACTIVATION

BACKGROUND

This relates generally to displays, and more particularly, to displays with backlights.

Displays such as liquid crystal displays and other displays sometimes include backlight units. A backlight unit may include an array of light-emitting diodes or other light source for producing backlight illumination. Displays with backlight units may be incorporated into an electronic device such as a computer or cellular telephone or may be implemented as stand-alone units.

To conserve power, displays can be powered down when not in use. When it is desired to display information for a user, a display that has been powered down can be powered up and provided with video data. As part of a display power-up sequence, a graphics controller such as a video card in a computer can send a control signal to a backlight controller in an associated display that instructs the backlight controller to turn on a backlight unit for the display.

There are typically delays associated with activating backlight units in displays. If care is not taken, these delays can be obtrusive and may give rise to an appearance of sluggish display behavior.

It would therefore be desirable to be able to provide improved ways in which to power up displays that have backlights.

SUMMARY

A system may include a graphics controller and a display. The graphics controller may generate video data to display on the display. The display may include a display panel for displaying the video data, a backlight unit for providing the display panel with backlight, and a display timing controller for communicating with the graphics controller over a communications path. The communications path may include a video data path for conveying video data bits, an interrupt path for conveying interrupts, and a sideband control path for conveying control signals such as a backlight enable signal for the backlight unit.

The graphics controller and timing controller may perform link training operations to assess link quality between the graphics controller and timing controller. The timing controller may assert interrupts to inform the graphics controller of system status. For example, the timing controller may assert an interrupt when the timing controller is ready to communicate with the graphics controller, may assert an interrupt when the timing controller has been fully initialized and is capable of performing pixel processing tasks, may assert an interrupt when a pipeline in the timing controller has received a frame of video data from the graphics controller, and may assert interrupts at other times. Use of the interrupts may help the system minimize the time consumed during display power-up operations. Power-up operations can also be minimized by transmitting valid video data as soon as link training operations are complete.

Further features of the invention, its nature and various advantages will be more apparent from the accompanying drawings and the following detailed description of the preferred embodiments.

DETAILED DESCRIPTION

Figure 1:
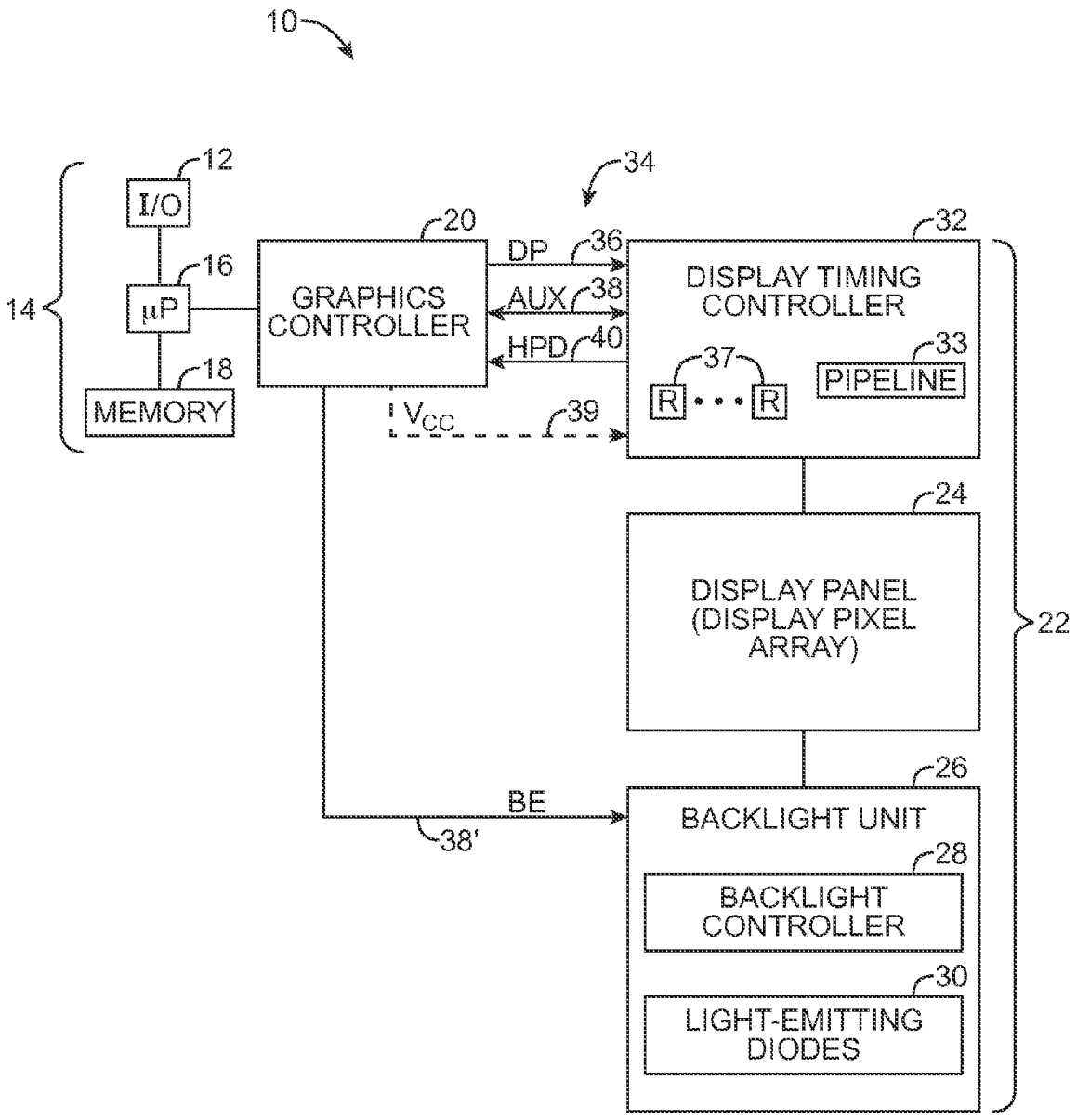
FIG. 1 is a perspective view of an illustrative system with a display in accordance with an embodiment of the present invention.

An illustrative system of the type that may include a display is shown in FIG. 1. As shown in FIG. 1, system 10 may include a graphics controller such as graphics controller 20 and a display such as display 22. Graphics controller 20, which may sometimes be referred to as a video card or video adapter, may be used to provide video data and control signals to display 22. The video data may include text, graphics, images, moving video content, or other content to be presented on display 22.

Graphics controller 20 may receive video data to be displayed on display 22 from control circuitry 14 in system 10. Control circuitry 14 may include processing circuitry 16 and storage 18. Processing circuitry 16 may include one or more processors such as microprocessors, microcontrollers, digital signal processors, application-specific integrated circuits, or other processing circuits. Storage 18 may include random-access memory, read-only memory, solid state memory in a solid state hard drive, magnetic storage, and other volatile and/or nonvolatile memory.

Input-output components 12 such as sensors, touch sensor arrays, keyboards, buttons, microphones that receive voice input and other audio input, speakers that provide audio output, vibrators, status indicator lights, wireless and wired communications circuits for communicating with external equipment, and other components may be used for receiving input from a user or other external source and/or for conveying output to a user or other external destination.

Display 22 may include a display panel such as display panel 24, timing controller (TCON) circuitry such as display timing controller 32 (e.g., a TCON integrated circuit), and backlight structures such as backlight unit 26. Display panel 24 may be a liquid crystal display module containing an array of display pixels, an electrophoretic display, an electrowetting display, or display structures using other types of display technologies. Backlight unit 26 may include backlight control circuitry such as backlight controller 28 and an associated light source that is controlled by backlight controller 28 such as light-emitting diode light source 30.

Communications path 34 may be used to convey information between graphics controller 20 and display 22. Communications path 34 may include video data path 36 for conveying video data bits (DP) from graphics controller 20 to display timing controller 32, a bidirectional sideband control path 38 for conveying sideband control signals (e.g., AUX signals) between graphics controller 20 and display 22, and an interrupt path for conveying interrupts such as display interface interrupt HPD from display timing controller 32 to graphics controller 20. Path 38' may be used to convey a control signal such as backlight enable control signal BE from graphics controller 20 to backlight unit 26. Path 38' may be considered to form part of communications path 34 (e.g., path 38' may be considered to be part of bidirectional sideband control path 38 in communications path 34).

The components of system 10 may be integrated into a single piece of electronic equipment or multiple pieces of electronic equipment. For example, system 10 may be implemented as a single electronic device such as a portable computer, a tablet computer, a cellular telephone, a media player, a computer display that includes an embedded computer, a television, or other stand-alone electronic equipment. In this type of configuration, communications path 34 may be formed from an internal bus. If desired, system 10 may include a first piece of equipment such as a desktop computer, set-top box, or other equipment (formed from input-output circuitry 12, control circuitry 14, and graphics controller 20) that is coupled by path 34 to a second piece of equipment (e.g., a display such as display 22 that is mounted in a display housing to form a stand-alone computer display or other monitor). In this type of configuration, path 34 may be formed as part of a cable (e.g., a display cable). The display cable may be pigtailed to the first piece of equipment, may be pigtailed to the second piece of equipment, or may be a stand-alone cable having a first end coupled to the first piece of equipment and an opposing second end coupled to the second piece of equipment. Configurations for system 10 that include more than two pieces of equipment or that include components that are embedded into kiosks, automobiles, or other systems may also be used, if desired.

Following a period of inactivity (e.g., after a predetermined period of time has passed without receiving input via input-output circuitry 12), display backlight controller 28 may receive instructions on path 38' from graphics controller 20 or other circuitry in system 10 that direct display backlight controller 28 to power down light-emitting diodes 30 and thereby depower the backlight for display 22. As an example, graphics controller 20 may dessert a control signal such as backlight enable signal BE. In response to receiving instructions to turn off light-emitting diodes 30, display backlight controller 28 may cut off power to light-emitting diodes 30, thereby preventing backlight from backlight unit 26 from illuminating display panel 24.

When activity is detected that warrants the production of backlight for display 22, graphics controller 20 or other circuitry in system 10 may direct backlight controller 28 to turn on light-emitting diodes 30. For example, graphics controller 20 or other equipment in system 10 may assert backlight enable signal BE on line 38' in sideband control channel 38.

The amount of time consumed with performing display power-up operations can be minimized by using display timing controller 32 to provide graphics controller 20 with interrupts that convey information on the status of display timing controller 32 to graphics controller 20 and/or by transmitting valid video data from graphics controller 20 to display 22 as soon as possible in the power-up cycle. Display timing controller 32 may, for example, transmit interrupts from display 22 to graphics controller 20 as soon as display 22 is ready to receive valid video data from graphics controller 20 and is ready to turn on backlight unit 28. A timing diagram showing how power-up time may be minimized is shown in FIG. 2.

Figure 2:
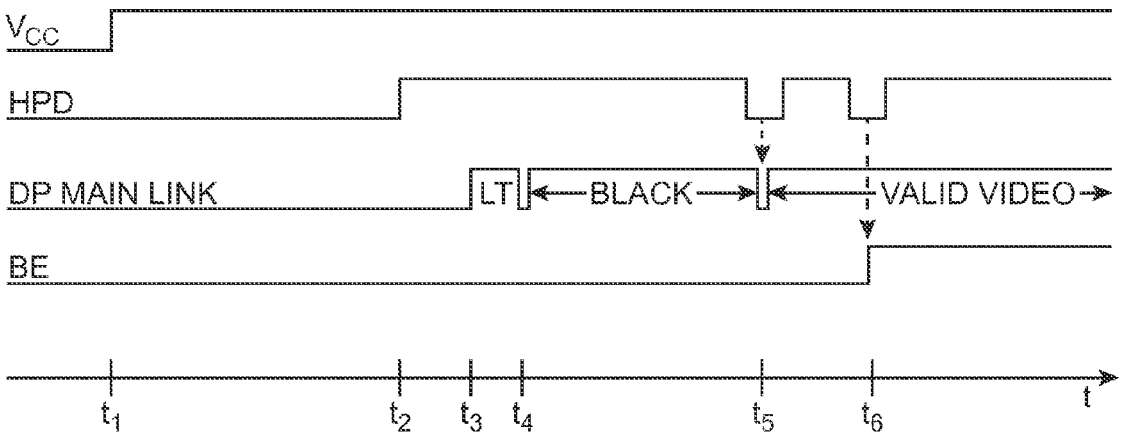
FIG. 2 is timing diagram showing illustrative signals that may be conveyed between a graphics controller and a display in accordance with an embodiment of the present invention.

As shown by trace Vcc in FIG. 2, system 10 may power up display 22 by providing a power supply voltage Vcc to display 22 at time t1 (e.g., using path 39 in FIG. 1). Power supply Vcc may, for example, be taken from ground (e.g., zero volts or other suitable ground voltage) to a positive (or negative) power supply voltage level in response to detection of a button press, detection of a touch event, or satisfaction of other suitable power-up initialization criteria.

Following the powering up of voltage Vcc at time t1, timing controller 32 detects that Vcc has gone high and begins booting up. During timing controller boot-up operations, timing controller 32 may load an initialization routine that allows timing controller 32 to communicate with graphics controller 20 over communications path 34 (e.g., using video data DP and sideband control signals AUX). The initialization routine code that is initially activated may not include code for handling pixel processing tasks such as color correction tasks. These pixel processing tasks may be supported by timing controller 32 only after additional code and settings are loaded and used to fully initialize the timing controller.

After a time t2–t1 of about 50 milliseconds or other suitable time period has elapsed, display timing controller 32 will be ready to communicate with graphics controller 20. Timing controller 32 may therefore assert an interrupt such as interrupt HPD on path 40 to inform graphics controller 20 that timing controller 32 is ready.

At time t3, graphics controller 20 detects the assertion of interrupt HPD from timing controller 32 and, in response to detecting the presence of an interrupt that signals that timing controller 32 is ready to communicate, graphics controller 20 may begin link training (LT). During link training operations, the quality of path 34 may be assessed by graphics controller 20 and timing controller 32 (e.g., to establish suitable data communications rates for use by graphics controller 20 and timing controller 32). At time t4, following completion of link training operations, graphics controller 20 may transmit invalid video data (i.e., null data that does not correspond to actual user information such as text, graphics, still images, or moving images). An example of invalid video data that may be transmitted by graphics controller 20 is black pixel data. Other types of invalid video data may be transmitted, if desired.

By time t5, timing controller 32 has become fully initialized. In response to becoming fully initialized, timing controller 32 may signal to graphics controller 20 that timing controller 32 is ready to receive live video data (e.g., valid video data bits DP that correspond to actual information to be displayed for a user and used by the user such as text that is read by the user or graphics, still images, or moving video content that is viewed by the user). Timing controller 32 may, for example, assert interrupt HPD by momentarily taking HPD low at time t5 (i.e., by toggling HPD).

Registers 37 (FIG. 1) may be used to store information that indicates the nature of an event associated with an asserted interrupt. Graphics controller 20 may detect the toggling of interrupt HPD at time t5, may check the contents of registers 37 via AUX line 36, and may, in response to a determination that timing controller is fully initialized and is ready to receive valid video data, immediately transmit live video data (video bits DP) to display timing controller 32 over video data path 36 within communications path 34. The amount of time t5–t4 for which graphics controller 20 transmits the black pixel data (or other invalid video data) is not limited to a particular minimum time period. Rather, valid video data can be transmitted from graphics controller 20 to timing controller 32 as soon as timing controller 32 is capable of effectively receiving and processing the valid video data. This can help minimize power-up time.

Timing controller 32 may include a buffer such as video data pipeline 33 (FIG. 1) that is used in receiving video data. At time t6, as soon as timing controller 32 detects that the pipeline has been filled with a complete frame of video data, timing controller 32 may again assert interrupt HPD (e.g., by toggling HPD). Graphics controller 20 may detect that the interrupt HPD has been asserted and may, in response to detecting interrupt HPD from timing controller 32, assert backlight enable signal BE so that backlight unit 26 turns on light-emitting diodes 30 to produce backlight for display panel 24.

Figure 3:
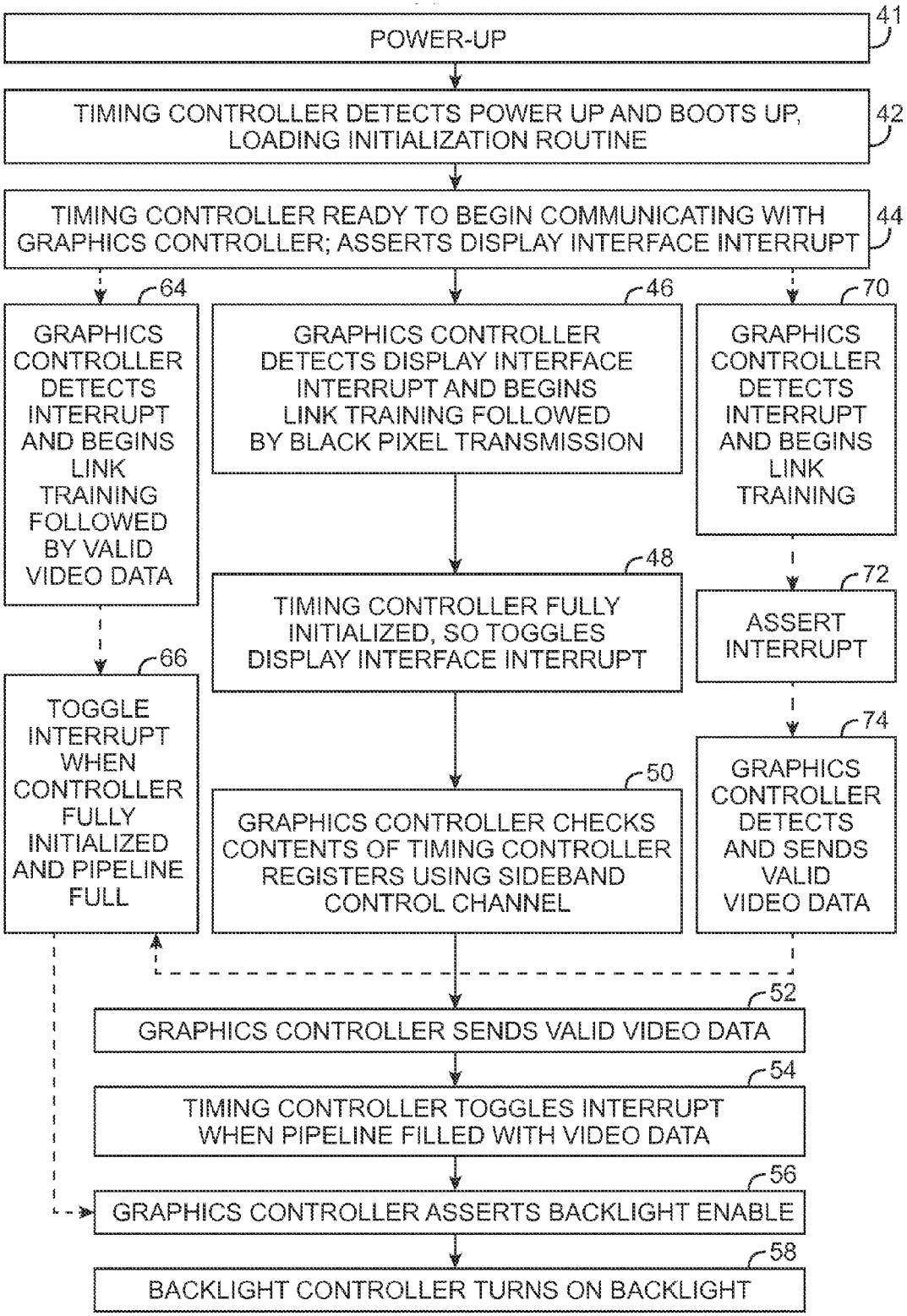
FIG. 3 is a flow chart of illustrative steps involved in powering up a display in accordance with embodiments of the present invention.

Illustrative steps involved in performing the operations associated with the timing diagram of FIG. 2 are shown the flow chart of FIG. 3.

At step 41, system 10 (e.g., graphics controller 20) may power up display 22. For example, power supply voltage Vcc may be taken from ground to a valid positive power supply voltage level such as a value in the range of 0.5 to 5 volts.

At step 42, display timing controller 32 may detect the rise in Vcc to a valid power supply level and may, in response, begin a boot-up process that involves loading an initialization routine (e.g., code and settings for operating display timing controller 32).

As described in connection with the assertion of interrupt HPD at time t2 of FIG. 2, display timing controller 32 may, at step 44, assert a display interface interrupt when display timing controller 32 is ready to begin communicating with graphics controller 20.

At step 46, graphics controller 20 may detect the display interface interrupt (e.g., signal HPD at time t2) and may, in response, begin link training (LT) at time t3 followed by transmission of invalid data such as black pixel data (BLACK) at time t4 (e.g., immediately after completion of link training operations), as shown in FIG. 2.

At step 48 of FIG. 3, timing controller 32 has become fully initialized (i.e., sufficient resources have been made available to allow timing controller 32 to receive valid video). Timing controller 32 may therefore assert the display interface interrupt (e.g., timing controller 32 may toggle interrupt signal HPD at time t5).

At step 50, graphics controller 20 may, in response to detection of the assertion of the display interface interrupt at time t5, use sideband control channel AUX to check the contents of timing controller registers 37, which indicate to graphics controller 20 that timing controller 32 is ready to receive valid video data.

In response to determining that timing controller 32 is ready to receive valid video data, graphics controller may, at step 52, send valid video data to display timing controller 32 over data path 36 (i.e., graphics controller 20 may send valid video signals DP beginning at time t5).

As shown by step 54, timing controller 32 may assert display interface interrupt HPD at time t6 in response to detection that pipeline 33 has been filled with a full frame of valid video data from graphics controller 20.

At step 56, in response to detection of the asserted display interface interrupt from timing controller 32 at time t6, graphics controller 20 may assert backlight enable signal BE to direct display 22 to produce backlight for display panel 24.

At step 58, in response to detection of the assertion of backlight enable signal BE by backlight controller 28, backlight unit 26 may turn on light-emitting diodes 30 to provide backlight for display panel 24.

If desired, display timing controller 32 may transmit valid video rather than black pixel data or other invalid data, thereby allowing the backlight for display 22 to be turned on upon the full initialization of display timing controller 32. A timing diagram illustrating how system 10 may operate in scenarios of this type is shown in FIG. 4.

Figure 4:
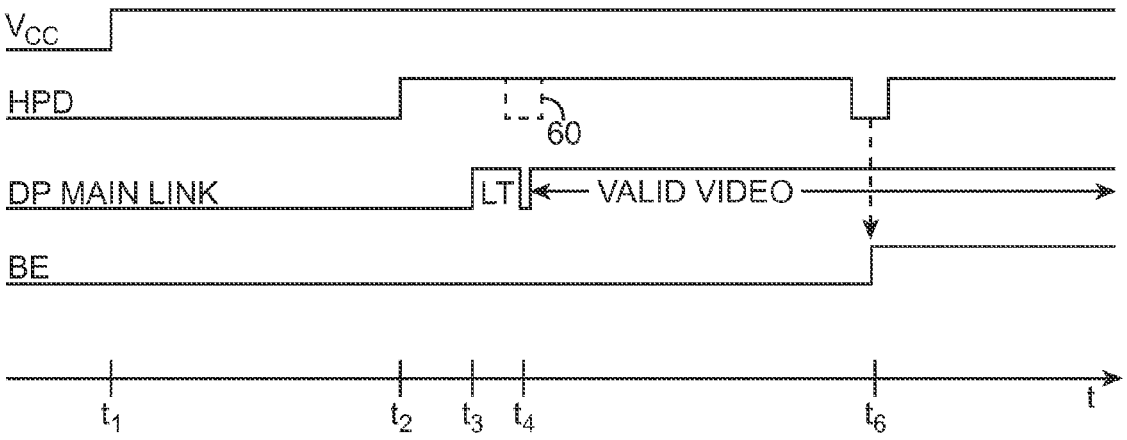
FIG. 4 is a timing diagram showing illustrative signals that may be conveyed between a graphics controller and a display in accordance with additional embodiments of the present invention.

As shown by signal Vcc in FIG. 4, system 10 may power up display 22 by providing a power supply voltage Vcc to display 22 at time t1 using path 39 of FIG. 1.

Following the powering up of voltage Vcc at time t1, timing controller 32 detects that Vcc has reached a valid power supply level and initiates a boot-up process. As timing controller 32 boots up, timing controller 32 will load an initialization routine to support communications between timing controller 32 and graphics controller 20 over communications path 34. Initially, timing controller 32 may only be initialized sufficiently to communicate with graphics controller 20. Upon full initialization, timing controller 32 will be capable of receiving and processing valid video data (e.g., timing controller 32 may will be capable of handling pixel processing tasks such as color correction tasks).

After a time t2–t1 of about 50 milliseconds or other suitable time period has elapsed, display timing controller 32 will be ready to communicate with graphics controller 20. Display timing controller 32 may therefore assert an interrupt such as interrupt HPD at time t2 on path 40 to inform graphics controller 20 that timing controller 32 is ready to communicate.

By time t3, graphics controller 20 has detected the assertion of interrupt HPD from timing controller 32 and may begin link training (LT) to assess the quality of path 34 between graphics controller 20 and timing controller 32, as illustrated by step 64 of FIG. 3. At time t4, as soon as link training operations are complete, graphics controller 20 may, during the operations of step 64, begin transmitting valid video data (i.e., graphics controller 20 may unilaterally begin valid video transmission rather than sending black pixels or other invalid data while awaiting assertion of the interrupt at time t5 of FIG. 2).

With this type of approach, timing controller 32 may, at step 66, assert the display interface interrupt at time t6 (e.g., controller 32 may toggle HPD) to indicate both that timing controller 32 has been fully initialized and that timing controller 32 has received a full frame of valid video data in pipeline 33.

Graphics controller 20 can detect the assertion of HPD at time t6 and can turn on the backlight for display 22 by asserting backlight enable signal BE (step 56).

At step 58, backlight unit 26 may turn on light-emitting diodes 30 to provide backlight for display panel 24 in response to detection of the assertion of backlight enable signal BE by backlight controller 28.

Another illustrative approach involves the assertion of optional interrupt signal 60 of FIG. 4. With this approach, timing controller 32 asserts the display interface interrupt early (i.e., as soon as link training LT is complete at time t4), so that valid video may be queued up as soon as possible. As shown in FIG. 3, graphics controller 20 may, at step 70, detect the interrupt asserted by timing controller 32 at time t2 that indicates that timing controller 32 is ready to begin communicating with graphics controller 20 and may begin link training. As soon as link training is complete at time t4, timing controller 32 may assert display interface interrupt 60 of FIG. 4 (step 72). Graphics controller 20 may detect the assertion of interrupt 60 and, in response, may begin transmission of valid video (signal DP) to timing controller 32 over path 36 at time t4 (step 74).

It may be desirable to ensure that the operations of system 10 are protocol compliant. As an example, it may be desired to ensure compatibility with the DisplayPort protocol during display power-up operations. DisplayPort compatibility may be achieved by setting the DisplayPort "sink specific" bit in registers 37 that is associated with use of interrupt signals HPD—i.e., 0x201 (bit 6) and by defining an additional vendor status register that contains an extra two bits (one for valid video start and one for backlight on).

The foregoing is merely illustrative of the principles of this invention and various modifications can be made by those skilled in the art without departing from the scope and spirit of the invention.

What is claimed is:

1. A method for operating a system that includes a graphics controller and a display with a display timing controller and a backlight unit, wherein the graphics controller and the display communicate over a communications path, and wherein the display timing controller includes a pipeline, the method comprising:

with the graphics controller, transmitting initial video data to the display timing controller, wherein the initial video data comprises black pixel data;

with the display timing controller, asserting an interrupt during the transmission of the initial video data by the graphics controller that informs the graphics controller that the display timing controller is initialized and ready to receive valid video data;

with the graphics controller, detecting the interrupt;

in response to detection of the interrupt, transmitting valid video data in place of the black pixel data;

with the display timing controller, asserting an additional interrupt during the transmission of the valid video data to inform the graphics controller that the pipeline contains a frame of the valid video data;

with the graphics controller, detecting assertion of the additional interrupt; and in response to detection of the assertion of the additional interrupt, using the graphics controller to turn on the backlight unit to provide backlight for the display.

2. The method defined in claim 1 further comprising:

with the graphics controller, performing link training operations before transmitting the initial video data.

3. The method defined in claim 2 wherein transmitting the initial video data comprises transmitting the initial video data immediately after performing the link training operations.

4. The method defined in claim 3 wherein transmitting the initial video data immediately after performing the link training operations comprises transmitting invalid video data with the graphics controller.

5. The method defined in claim 1 wherein the communications path includes a sideband control signal path, a display interrupt path over which the asserted interrupt is conveyed, and a video data bit path and wherein transmitting the initial video data comprises transmitting the initial video data over the video data bit path.

6. The method defined in claim 5 further comprising transmitting a backlight enable signal over the sideband control signal path in response to receipt by the graphics controller of the additional interrupt.

7. The method defined in claim 6 further comprising conveying the interrupt and the additional interrupt from the display timing controller to the graphics controller over the display interrupt path.

8. A method for communicating between a display that has a display timing controller, a backlight unit, and a graphics controller, comprising:

with the display timing controller, receiving initial video data from the graphics controller;

while receiving the initial video data, asserting an interrupt with the display timing controller that informs the graphics controller that the display timing controller is initialized and ready to receive valid video data;

with the display timing controller, performing link training operations to assess link quality between the display timing controller and the graphics controller, wherein receiving the initial video data comprises receiving black pixel data from the graphics controller immediately after completion of the link training operations and wherein asserting the interrupt comprises toggling an interrupt signal while receiving the black pixel data;

with the display timing controller, receiving valid video data following receipt of the black pixel data; and asserting an additional interrupt during receipt of the valid video data to direct the graphics controller to turn on the backlight unit.

9. A method for communicating between a graphics controller and a display having a backlight unit, wherein the display has a display timing controller, the method comprising:

with the display timing controller, performing link training operations to assess link quality between the display timing controller and the graphics controller;

immediately after completing the link training operations, receiving valid video data from the graphics controller with the display timing controller; and while receiving the valid video data, asserting an interrupt with the display timing controller that directs the graphics controller to assert a backlight enable signal to turn on the backlight unit.

10. The method defined in claim 9 further comprising:

with the backlight unit, receiving the backlight enable signal from the graphics controller and turning on a backlight light source in response to receipt of the backlight enable signal.

11. A method for communicating between a display and a graphics controller, wherein the display has a display timing controller, the method comprising:

performing link training operations with the display timing controller to asses link quality between the display timing controller and the graphics controller;

immediately after completing the link training operations, asserting an interrupt with the display timing controller to direct the graphics controller to transmit valid video to the display timing controller;

receiving the valid video data from the graphics controller with the display timing controller;

while receiving the valid video data, asserting an additional interrupt with the display timing controller that directs the graphics controller to assert a backlight enable signal; and with a backlight unit in the display, receiving the backlight enable signal from the graphics controller and providing backlight for the display.

* * * * *